US009453396B2

(12) United States Patent
Davis

(10) Patent No.: US 9,453,396 B2
(45) Date of Patent: Sep. 27, 2016

(54) OIL WELL PUMP APPARATUS

(71) Applicant: Raymond C. Davis, Lake Charles, LA (US)

(72) Inventor: Raymond C. Davis, Lake Charles, LA (US)

( * ) Notice: Subject to any disclaimer, the term of this patent is extended or adjusted under 35 U.S.C. 154(b) by 580 days.

(21) Appl. No.: 13/691,263

(22) Filed: Nov. 30, 2012

(65) Prior Publication Data

US 2013/0180704 A1 Jul. 18, 2013

Related U.S. Application Data

(60) Provisional application No. 61/566,312, filed on Dec. 2, 2011.

(51) Int. Cl.

| | |
|---|---|
| ***F04B 35/02*** | (2006.01) |
| ***E21B 43/12*** | (2006.01) |
| ***F04B 47/08*** | (2006.01) |

(52) U.S. Cl.

CPC ..... *E21B 43/121* (2013.01); *E21B 43/129* (2013.01); *F04B 47/08* (2013.01)

(58) Field of Classification Search

CPC ..... F04B 47/08; F04B 47/04; F04C 2/084; F04C 13/008; E21B 43/121; E21B 43/129

USPC ..... 417/406, 407

See application file for complete search history.

(56) References Cited

U.S. PATENT DOCUMENTS

| | | | | |
|---|---|---|---|---|
| 3,171,355 | A * | 3/1965 | Harris et al. | 417/365 |
| 4,003,678 | A * | 1/1977 | David | 417/88 |
| 4,336,005 | A * | 6/1982 | McBurnett et al. | 418/126 |
| 7,270,186 | B2 * | 9/2007 | Johnson | 166/369 |
| 2006/0153695 | A1 * | 7/2006 | Davis | 417/199.1 |
| 2013/0020070 | A1 * | 1/2013 | Davis | 166/105.1 |

FOREIGN PATENT DOCUMENTS

| | | | |
|---|---|---|---|
| DE | 2554608 | * | 8/1976 |
| GB | 778489 | * | 7/1957 |

* cited by examiner

*Primary Examiner* — Charles Freay

(74) *Attorney, Agent, or Firm* — Garvey, Smith, Nehrbass & North, L.L.C.; Charles C. Garvey, Jr.; Vanessa M. D'Souza

(57) ABSTRACT

An oil well pumping apparatus for pumping oil from a well to a wellhead provides a tool body that is sized and shaped to be lowered into the production tubing string of the oil well. A working fluid is provided that can be pumped into the production tubing. A flow channel into the well bore enables the working fluid to be circulated from the prime mover via the production tubing to the tool body at a location in the well and then back to the wellhead area. A pumping mechanism is provided on the tool body, the pumping mechanism includes upper and lower impeller devices. The upper impeller device is driven by the working fluid. The lower impeller device is rotated by the upper impeller device. Each upper and lower impeller devices are connected with a shaft. A specially configured flow diverter directs the working fluid to an impeller blade in between the top and bottom of an upper impeller device.

20 Claims, 18 Drawing Sheets

OIL WELL PUMP APPARATUS

CROSS-REFERENCE TO RELATED APPLICATIONS

This is a nonprovisional Patent Application of U.S. Provisional Patent Application Ser. No. 61/566,312, filed 2 Dec. 2011, which is hereby incorporated herein by reference.

Priority of U.S. Provisional Patent Application Ser. No. 61/566,312, filed 2 Dec. 2011, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to oil well pumps. More particularly, the present invention relates to a downhole oil well pump apparatus that uses a circulating working fluid to drive a specially configured pump that is operated by the working fluid and wherein the pump transmits oil from the well to the surface by commingling the pumped oil with the working fluid, oil and the working fluid being separated at the wellhead or earth's surface. Even more particularly, the present invention relates to an oil well pump that is operated in a downhole cased, production pipe environment that utilizes a pump having a single pump shaft that has impeller devices at each end of the pump shaft, one of the impeller devices being driven by the working fluid, the other impeller device pumping the oil to be retrieved.

2. General Background of the Invention

In the pumping of oil from wells, various types of pumps are utilized, the most common of which is a surface mounted pump that reciprocates between lower and upper positions. Examples include the common oil well pumpjack, and the Ajusta® pump. Such pumps reciprocate sucker rods that are in the well and extend to the level of producing formation. One of the problems with pumps is the maintenance and repair that must be performed from time to time.

BRIEF SUMMARY OF THE INVENTION

The present invention provides an improved pumping system from pumping oil from a well that provides a downhole pump apparatus that is operated with a working fluid that operates a specially configured pumping arrangement that includes a common shaft. One end portion of the shaft is an impeller that is driven by the working fluid. The other end portion of the shaft has an impeller that pumps oil from the well. In this arrangement, both the oil being pumped and the working fluid commingle as they are transmitted to the surface. A separator is used at the earth's surface to separate the working fluid (for example, water) and the oil.

The present invention includes an oil pump apparatus for pumping oil from an oil well having a wellhead and a well bore with casing and a production tubing string, comprising a tool body that is sized and shaped to be lowered into the production tubing string of an oil well, a casing and production tubing, a working fluid that can be pumped into the production tubing, a prime mover for pumping the working fluid, a flow channel in the well bore that enables the working fluid to be circulated from the prime mover via the production tubing to the tool body at a location in the well and then back to the wellhead area, a flow diverter structure mounted in the tool body, the flow diverter structure including a bearing and a vertically extending portion that extends down from the bearing, a pumping mechanism on the tool body, the pumping mechanism including a first pair of impellers that are driven by the working fluid and a second pair of impellers that are rotated by the first impellers, the second impellers pumping oil from the well via the tool body, each pair of impellers having blades that engage so that one impeller rotates with the other for each of said pairs, the first pair of impellers rotatably attached to the bearing part of the flow diverter, wherein the working fluid flows downwardly through the flow diverter and then to the first impellers, wherein the vertically extending portion of the flow diverter has a plurality of discharge ports including at least two discharge ports that form an obtuse angle and that direct fluid flow to the outer half of the impeller blades, wherein the tool body has flow conveying portions that mix the working fluid and the oil as the oil is pumped, and wherein the pumping mechanism transmits the commingled fluid of oil and working fluid to the wellhead area.

In one embodiment, the apparatus further comprises a filter in the tool body that is positioned to filter the working fluid before it reaches the pumping mechanism.

In one embodiment, the apparatus further comprises a filter in the tool body that is positioned to filter the oil being pumped before it reaches the pumping mechanism.

In one embodiment, the working fluid is water or oil or a mixture of oil and water.

In one embodiment, the working fluid is a fluid mixture of oil and water.

In one embodiment, the working fluid is oil.

The present invention includes an oil pump apparatus for pumping oil from an oil well having a wellhead and a well bore with casing and a production tubing string, comprising a tool body that is sized and shaped to be lowered into the production tubing string of an oil well, a casing and production tubing, a working fluid that can be pumped into the production tubing, a prime mover for pumping the working fluid, a flow channel in the well bore that enables the working fluid to be circulated from the prime mover via the production tubing to the tool body at a location in the well and then back to the wellhead area, a flow diverter carried in the tool body and positioned to receive flow from the flow channel, the flow diverter including a disk and a vertically extending portion attached to the disk and having a generally vertically oriented flow bore, a pumping mechanism on the tool body, the pumping mechanism including a first impeller that is driven by the working fluid and a second impeller that is rotated by the first impeller, the second impeller pumping oil from the well via the tool body, each impeller having radially extending blades, wherein the vertically extending portion of the flow diverter has a plurality of discharge ports including at least two discharge ports that form an obtuse angle and that direct fluid flow to the outer half of the impeller blades, wherein the tool body has flow conveying portions that mix the working fluid and the oil as the oil is pumped, wherein the pumping mechanism transmits the commingled fluid of oil and working fluid to the wellhead area.

The present invention includes an oil pump apparatus for pumping oil from an oil well having a wellhead and a well bore with casing and a production tubing string, comprising a tool body that is sized and shaped to be lowered into the production tubing string of an oil well, the tool body having a tool body bore and upper and lower end portions, a casing and production tubing, a working fluid that can be pumped into the production tubing, a prime mover for pumping the working fluid, a flow channel in the well bore that enables the working fluid to be circulated from the prime mover via the production tubing to the tool body at a location in the well and then back to the wellhead area, a flow diverter that occupies the tool body bore at the upper end portion of the tool body and positioned to receive flow from the flow channel, the flow diverter having a transverse disk and a downwardly extending member having discharge ports, a pumping mechanism on the tool body, the pumping mechanism including a first impeller that is driven by the working fluid and a second impeller that is rotated by the first impeller, the second impeller pumping oil from the well via the tool body, wherein each impeller has impeller teeth, wherein the tool body has flow conveying portions that mix the working fluid and the oil as the oil is pumped, wherein the pumping mechanism transmits the commingled fluid of oil and working fluid to the wellhead area, and wherein the flow diverter has a plurality of discharge ports that are vertically spaced apart to direct fluid to the first impeller at upper and lower positions.

In one embodiment, the apparatus further comprises a swab cup on the tool body that enables the tool body to be pumped to the well head area using the working fluid.

In one embodiment, the apparatus further comprises a swab cup on the tool body that enables the tool body to be pumped into the well bore via the production tubing string using the working fluid.

The present invention includes an oil pump apparatus for pumping oil from an oil well having a wellhead and a well bore with casing and a production tubing string, comprising a tool body that is sized and shaped to be lowered into the production tubing string of an oil well, a casing and production tubing, a working fluid that can be pumped into the production tubing, a prime mover for pumping the working fluid, a flow channel in the well bore that enables the working fluid to be circulated from the prime mover via the production tubing to the tool body at a location in the well and then back to the wellhead area, a pumping mechanism on the tool body, the pumping mechanism including a first impeller that is driven by the working fluid and a second impeller that is rotated by the first impeller, the second impeller pumping oil from the well via the tool body, wherein the tool body has flow conveying portions that mix the working fluid and the oil as the oil is pumped, wherein the pumping mechanism transmits the commingled fluid of oil and working fluid to the wellhead area, and a flow diverter that received flow from the flow channel and transmits that received flow to the impellers at first upper and second lower positions.

In one embodiment, the impellers include upper and lower pairs of impellers, each upper impeller connected to a lower impeller by a common shaft.

In one embodiment, the impellers include upper and lower impellers connected by a common shaft.

In one embodiment, the pumping mechanism includes upper and lower impeller mechanisms, each impeller mechanism having an inner rotor having multiple lobes that interfaces with an outer rotor having more lobes than the inner rotor.

In one embodiment, the apparatus further comprises a check valve positioned on the tool body above the pumping mechanism that prevents oil flow inside the tool body above the pumping mechanism.

In one embodiment, the apparatus further comprises a check valve positioned below the pumping mechanism that prevents the flow of the working fluid inside the tool body to a position below the tool body.

In one embodiment, the impellers include upper and lower impellers connected by only one common shaft.

The present invention includes an oil pump apparatus for pumping oil from an oil well having a wellhead and a well bore with casing and a production tubing string, comprising a tool body that is sized and shaped to be lowered into the production tubing string of an oil well, a casing and production tubing, a working fluid that can be pumped into the production tubing, a prime mover for pumping the working fluid, a flow channel in the well bore that enables the working fluid to be circulated from the prime mover via the production tubing to the tool body at a location in the well and then back to the wellhead area, a pumping mechanism on the tool body, the pumping mechanism including a first impeller that is driven by the working fluid and a second impeller that is rotated by the first impeller, the second impeller pumping oil from the well via the tool body, wherein the tool body has flow conveying portions that mix the working fluid and the oil as the oil is pumped, and wherein the pumping mechanism transmits the commingled fluid of oil and working fluid to the wellhead area.

In one embodiment, the apparatus further comprises a check valve on the tool body that prevents oil flow inside the tool body above the pumping mechanism.

In one embodiment, the apparatus further comprises a check valve on the tool body that prevents the flow of the working fluid inside the tool body to a position below the tool body.

In one embodiment, the impellers include upper and lower impellers connected by a common shaft.

In one embodiment, the pumping mechanism includes a impeller mechanism.

The present invention includes an oil pump apparatus for pumping oil from an oil well having a wellhead and a well bore with casing and a production tubing string, comprising a tool body that is sized and shaped to be lowered into the production tubing string of an oil well, a casing and production tubing, a working fluid that can be pumped into the production tubing, a prime mover for pumping the working fluid, a flow channel in the well bore that enables the working fluid to be circulated from the prime mover via the production tubing to the tool body at a location in the well and then back to the wellhead area, a pumping mechanism on the tool body, the pumping mechanism including a first impeller device that is driven by the working fluid and a second impeller device that is powered by the first impeller device, the second impeller device pumping oil from the well via the tool body, wherein the tool body has flow conveying portions that mix the working fluid and the oil as the oil is pumped, and wherein the pumping mechanism transmits the commingled fluid of oil and working fluid to the wellhead area.

The present invention provides an oil pump apparatus for pumping oil from an oil well having a wellhead and a well bore with casing and a production tubing string, comprising a tool body that is sized and shaped to be lowered into the production tubing string of an oil well, a casing and production tubing, a working fluid that can be pumped into the production tubing, a prime mover for pumping the working fluid, a flow channel in the well bore that enables the working fluid to be circulated from the prime mover via the production tubing to the tool body at a location in the well and then back to the wellhead area, a flow diverter structure mounted in the tool body, the flow diverter structure including a bearing and a vertically extending portion that extends down from the bearing, a pumping mechanism on the tool body, the pumping mechanism including a first pair of impellers that are driven by the working fluid and a second pair of impellers that are rotated by the first impellers, the second impellers pumping oil from the well via the tool body, each pair of impellers having blades that engage so that one impeller rotates with the other for each of said pairs, the first pair of impellers rotatably attached to the bearing part of the flow diverter, wherein the working fluid flows downwardly through the flow diverter and then to the first impellers, wherein the vertically extending portion of the flow diverter has a plurality of discharge ports including at least two discharge ports that form an obtuse angle and that direct fluid flow to the outer half of the impeller blades, wherein the tool body has flow conveying portions that mix the working fluid and the oil as the oil is pumped, and wherein the pumping mechanism transmits the commingled fluid of oil and working fluid to the wellhead area.

The present invention includes an oil pump apparatus for pumping oil from an oil well having a wellhead, a well bore, and a production tubing string, comprising a tool body that is sized and shaped to be lowered into the production tubing string of an oil well, a working fluid that can be pumped into the production tubing, a flow channel in the well bore that enables the working fluid to be circulated via the production tubing to the tool body at a location in the well and then back to the wellhead area, a flow diverter carried in the tool body and positioned to receive flow from the flow channel, the flow diverter including a disk and a vertically extending portion attached to the disk and having a generally vertically oriented flow bore, a pumping mechanism on the tool body, the pumping mechanism including first impellers that are driven by the working fluid and second impellers that are rotated by the first impellers, the second impellers pumping oil from the well via the tool body, wherein the vertically extending portion of the flow diverter has a plurality of discharge ports including at least two discharge ports that form an obtuse angle and that direct fluid flow to the impellers, wherein the tool body has flow conveying portions that mix the working fluid and the oil as the oil is pumped, and wherein the pumping mechanism transmits the commingled fluid of oil and working fluid to the wellhead area.

In one embodiment, the impellers include upper and lower pairs of impellers, each upper impeller connected to and rotating with a lower impeller.

In one embodiment, the working fluid is water.

In one embodiment, the working fluid is oil.

In one embodiment, the working fluid is a mixture of water and a material that is not water.

The present invention includes an oil pump apparatus for pumping oil from an oil well having a wellhead, a well bore, casing, and a production tubing string, comprising a tool body that is sized and shaped to be lowered into the production tubing string of an oil well, a working fluid that can be pumped into the production tubing, a flow channel in the well bore that enables the working fluid to be circulated via the production tubing to the tool body at a location in the well and then back to the wellhead area, a pumping mechanism on the tool body, the pumping mechanism including one or more upper impellers that are driven by the working fluid and one or more lower impellers that are rotated by the upper impellers, the lower impellers pumping oil from the well via the tool body, each impeller having a top and a bottom, a diverter that extends along the upper impellers and having one or more discharge openings that discharge the working fluid to the upper impeller at a position in between the top and bottom of the upper impeller, wherein the tool body has flow conveying portions that mix the working fluid and the oil as the oil is pumped, and wherein the pumping mechanism transmits the commingled fluid of oil and working fluid to the wellhead area.

In one embodiment, the working fluid is water or oil or a mixture of water and another material that is not water.

The present invention provides an oil pump apparatus for pumping oil from an oil well having a wellhead and a well bore with casing and a production tubing string, comprising a tool body that is sized and shaped to be lowered into the production tubing string of an oil well, a casing and production tubing, a working fluid that can be pumped into the production tubing, a prime mover for pumping the working fluid, a flow channel in the well bore that enables the working fluid to be circulated from the prime mover via the production tubing to the tool body at a location in the well and then back to the wellhead area, a pumping mechanism on the tool body, the pumping mechanism including an upper impeller device that is driven by the working fluid and a lower impeller device that is powered by the first impeller device, the lower impeller device pumping oil from the well via the tool body, and a diverter that extends along the upper impellers and having one or more discharge openings that discharge the working fluid to the upper impeller at a position in between the top and bottom of the upper impeller.

The present invention provides an oil well pumping apparatus for pumping oil from a well to a wellhead provides a tool body that is sized and shaped to be lowered into the production tubing string of the oil well. A working fluid is provided that can be pumped into the production tubing. A prime mover is provided for pumping the working fluid. A flow channel into the well bore enables the working fluid to be circulated from the prime mover via the production tubing to the tool body at a location in the well and then back to the wellhead area. A pumping mechanism is provided on the tool body, the pumping mechanism includes upper and lower spur gear or gears. The upper spur gear is driven by the working fluid. The lower spur gear is rotated by the first spur gear. The upper and lower spur gears are connected with a common shaft. If upper pairs and lower pairs of spur gears are employed, each upper and lower gear are connected via a common shaft. The tool body has flow conveying portions that mix the working fluid and the produced oil as the oil is pumped. The pumping mechanism transmits the commingled fluid of oil and working fluid to the wellhead area where they are separated and the working fluid recycled.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 21:
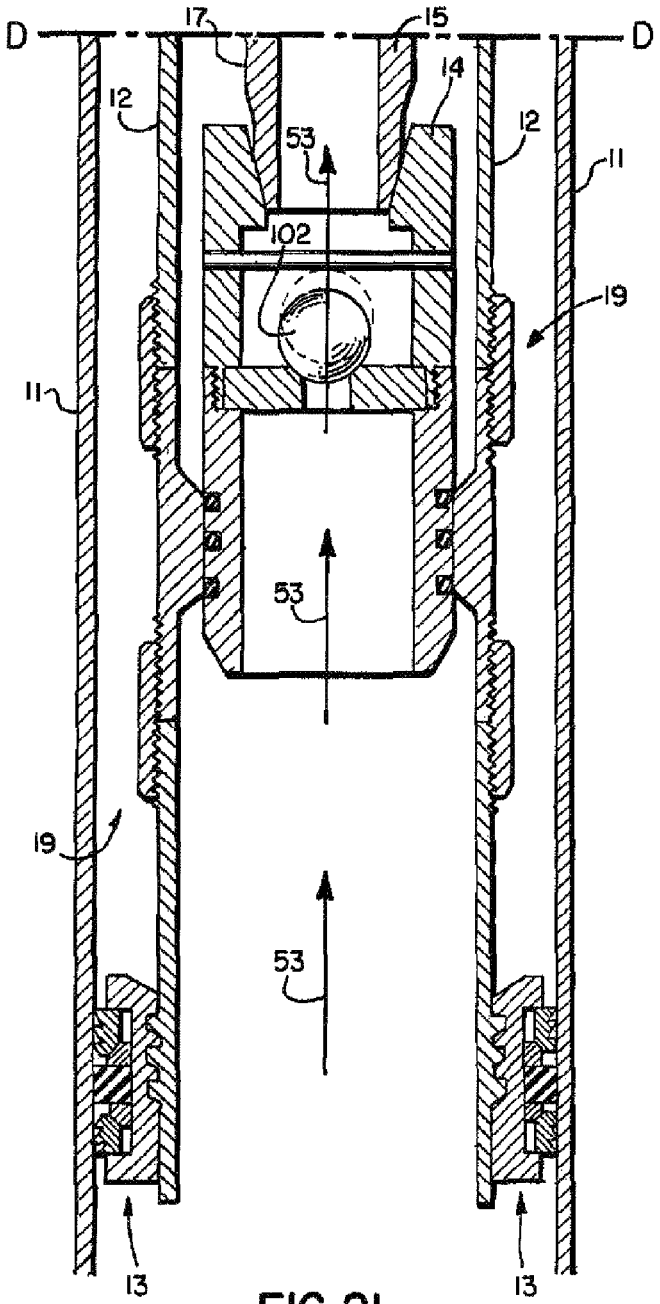
Figure 22:
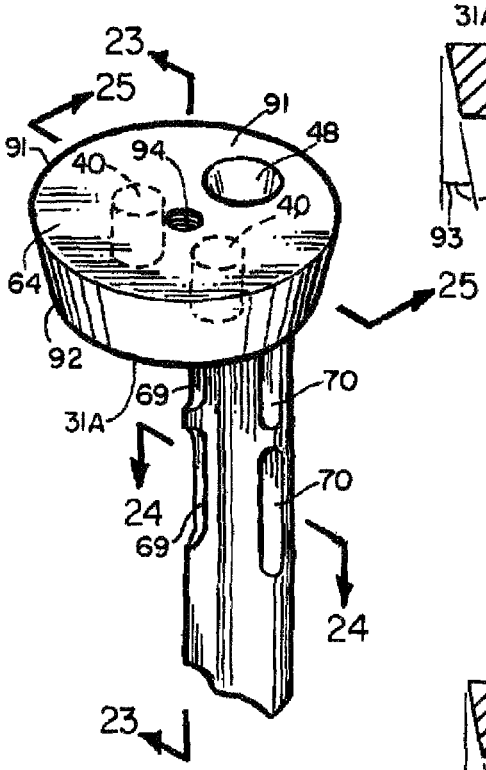
FIG. 22 is a fragmentary perspective view of a preferred embodiment of the apparatus of the present invention.

Oil well pump apparatus as shown in FIGS. 1-30, designated generally by the numeral 10. Oil well pump 10 is to be used in a well casing 11 that surrounds production tubing 12. A packer 13 is set in between casing 11 and production tubing 12 as shown in FIGS. 21 and 28. Landing nipple or seating nipple 14 is positioned above packer 13. The landing nipple 14 receives the lower end portion 17 of tool body 15 as shown in FIGS. 17-21 and 29. Tool body 15 has upper end portion 16. Tool body 15 can be pumped hydraulically or lowered into the production tubing 12 bore 18 using a work string (not shown) that grips neck portion 25 at tool body 15 upper end 16. Neck portion 25 can have annular shoulder 56 for assisting in forming a connection with a work string (see FIG. 17).

The apparatus 10 of the present invention provides an oil well pump 10 that has a tool body 15 that is elongated to fit inside of the bore 18 of production tubing 12 as shown in FIGS. 17-21. A well annulus 19 is that space in between casing 11 and production tubing 12. During use, a working fluid such as water, "lease" water, or an oil water mixture can be used to power pump mechanism 26 (see FIGS. 28-30). This working fluid follows the path that is generally designated by the arrows 49, 50 in FIG. 16. The working fluid is pumped from the wellhead area using a prime mover 121.

The prime mover 121 can be a commercially available pump (e.g., positive displacement pump) that receives working fluid via flowline 122 from reservoir 123 at wellhead area 120. Reservoir 123 is supplied with the working fluid such as water via flowline 124 that exits oil/water separator 125 (see FIGS. 28-30).

In the pumping mode of FIG. 28, working fluid (e.g., water) moves from the reservoir 123 to the prime mover 121. The prime mover 121 can be a positive displacement pump that pumps the working fluid through three way valve 130. In the pumping mode, three way valve 130 handle 131 is in the down position as shown in FIG. 28, allowing the working fluid or power fluid into the tubing 12. The working fluid pumps the tool body 15 into the seating nipple 14 and then provided swab cups or a seal or seals 57. If swab cups are used, they flare outwardly sealing against the tubing 12. In either case (swab cups or seal) a seal 57 causes the power fluid to then enter the channels 58 at the upper end 16 of the tool body 15 (see FIGS. 17, 28). The working fluid travels through bore 60 of tool section 47 and the center of the stacked disk upper filter 59 into the top or upper end 21 of pump housing section 20 of tool body 15. The upper impellers 27, 28 rotate and, in turn, cause the shafts 42, 43 to rotate which causes the lower impellers 29, 30 to turn (see FIGS. 13, 17-20, 26-28).

Figure 16:
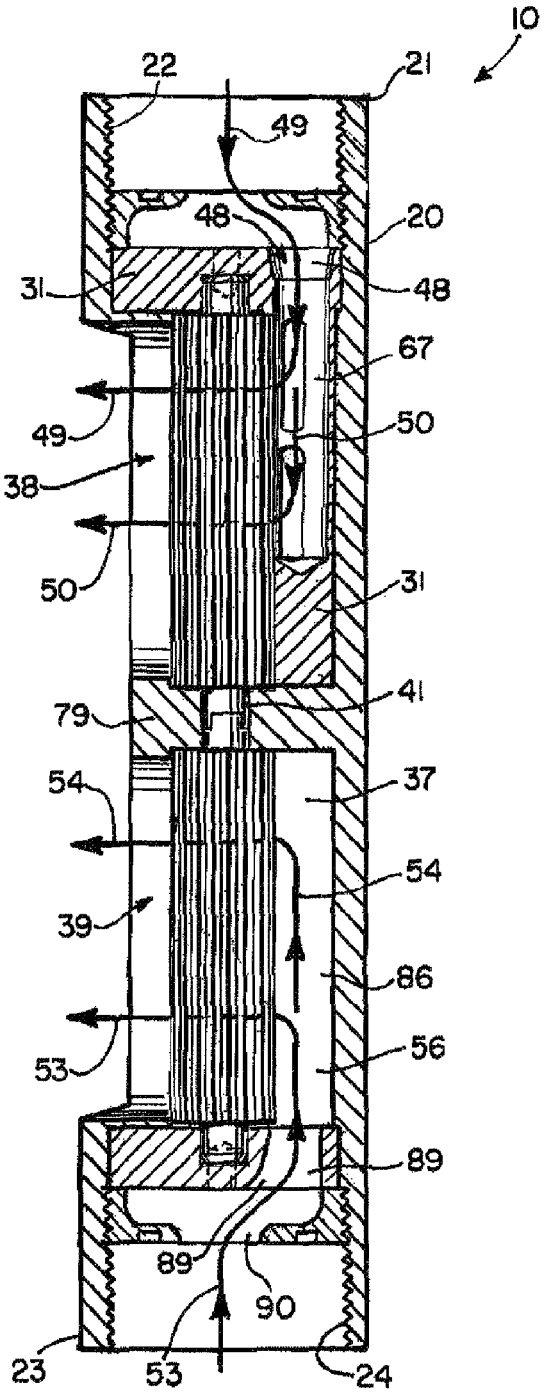
FIG. 16 is a sectional elevation view of a preferred embodiment of the apparatus of the present invention.
Figure 17:
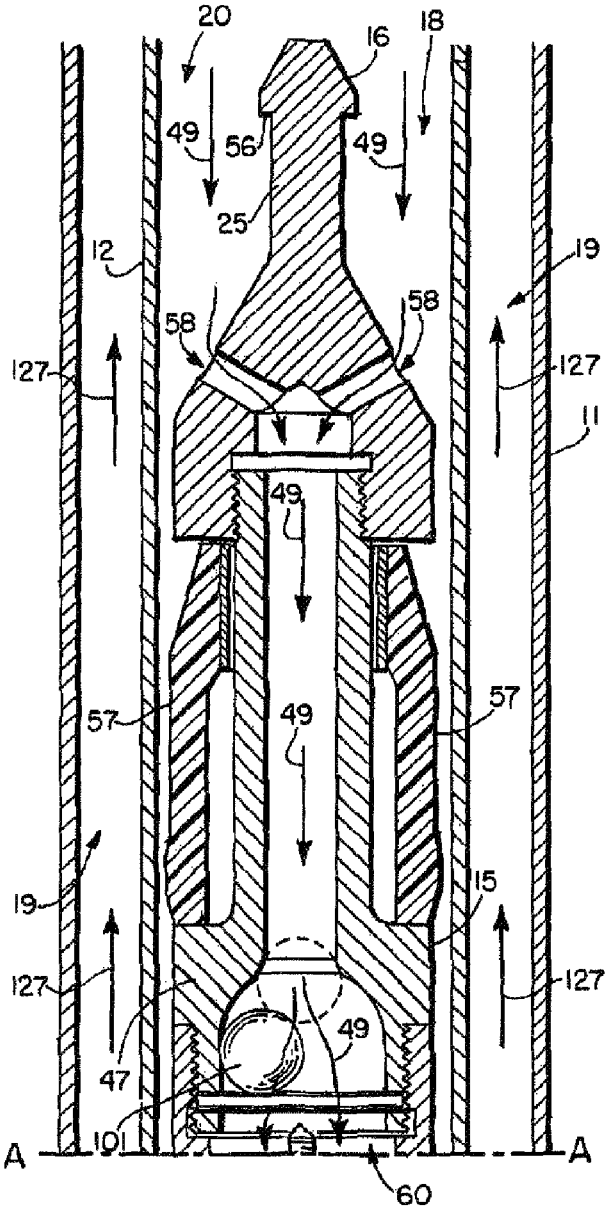
FIGS. 17-21 are sectional elevation views of a preferred embodiment of the apparatus of the present invention and wherein lines A-A of FIGS. 17-18 are match lines, lines B-B of FIGS. 18-19 are match lines, lines C-C of FIGS. 19-20 are match lines, and lines D-D of FIGS. 20-21 are match lines.
Figure 18:
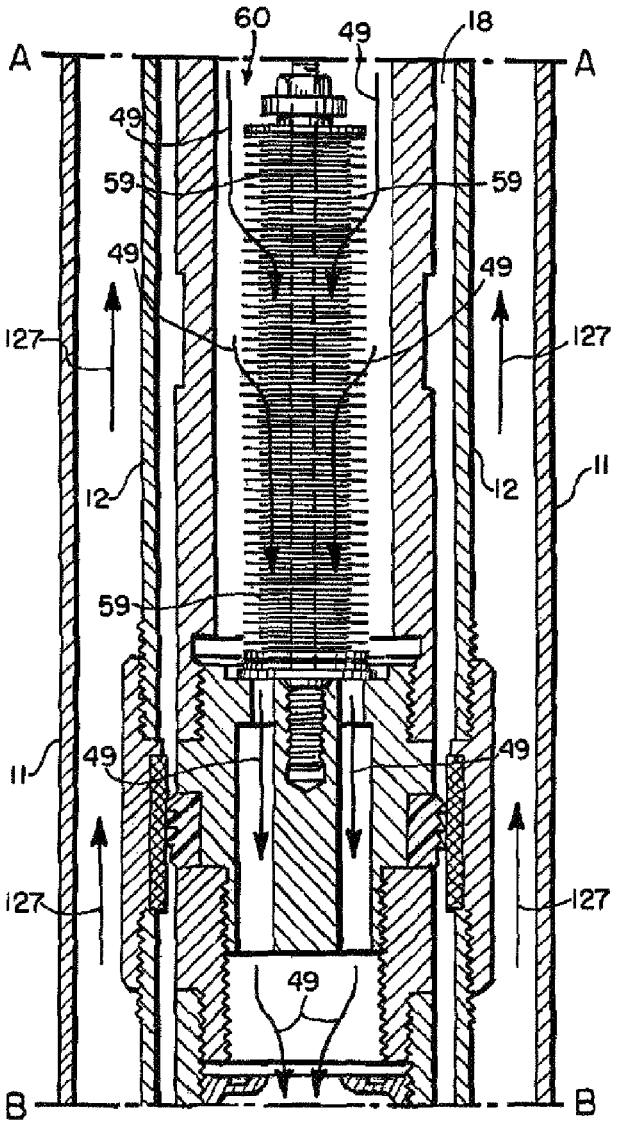
Figure 19:
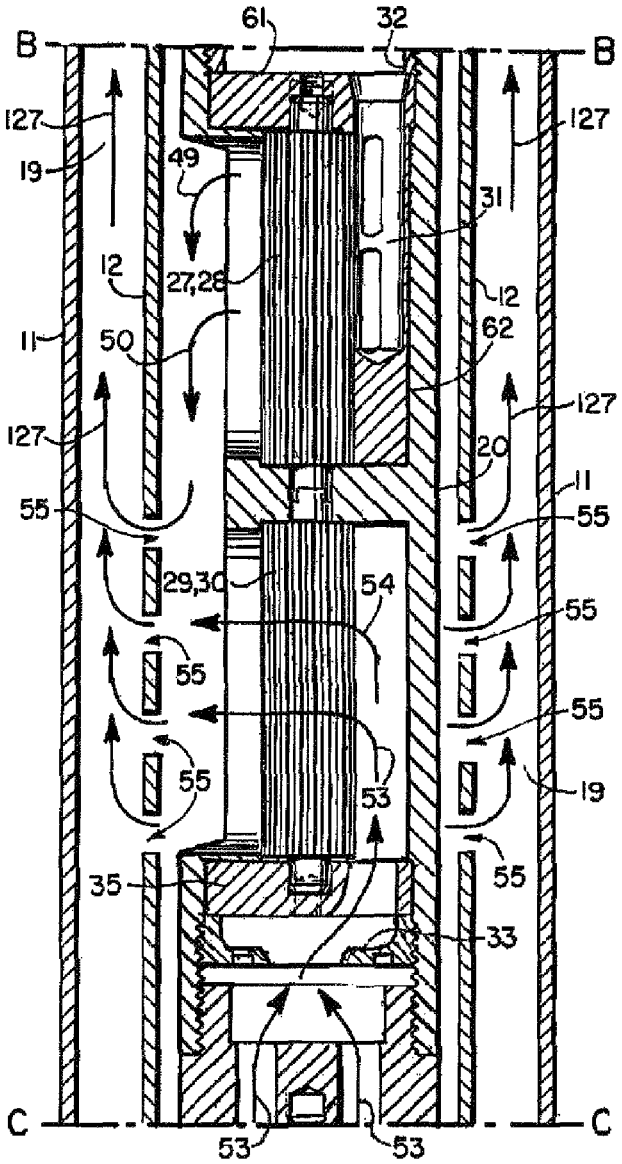
Figure 20:
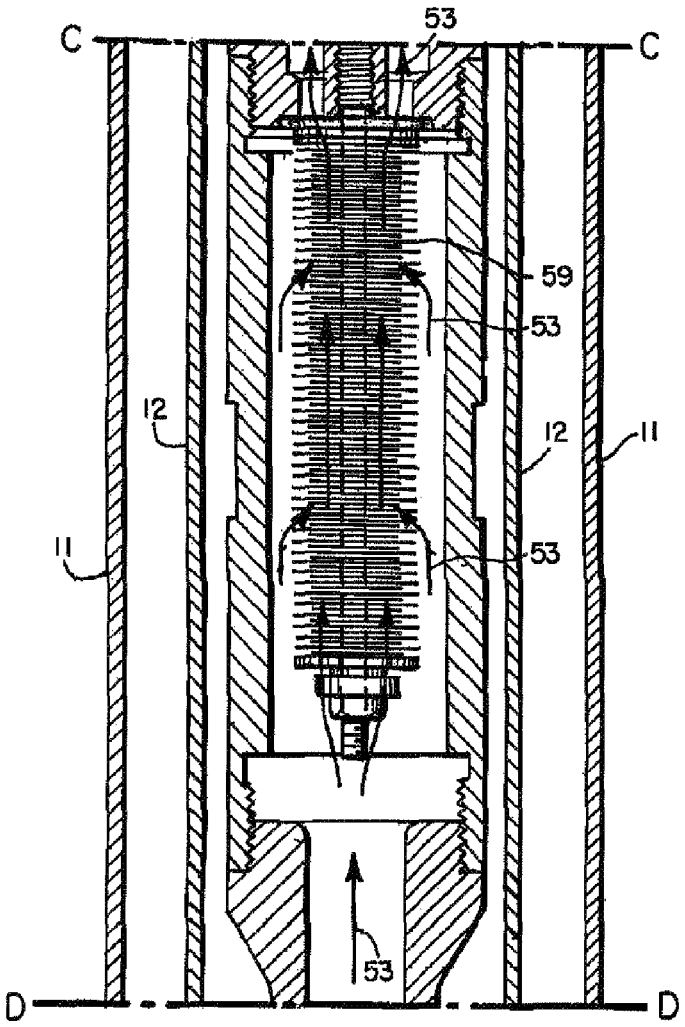
Figure 26:
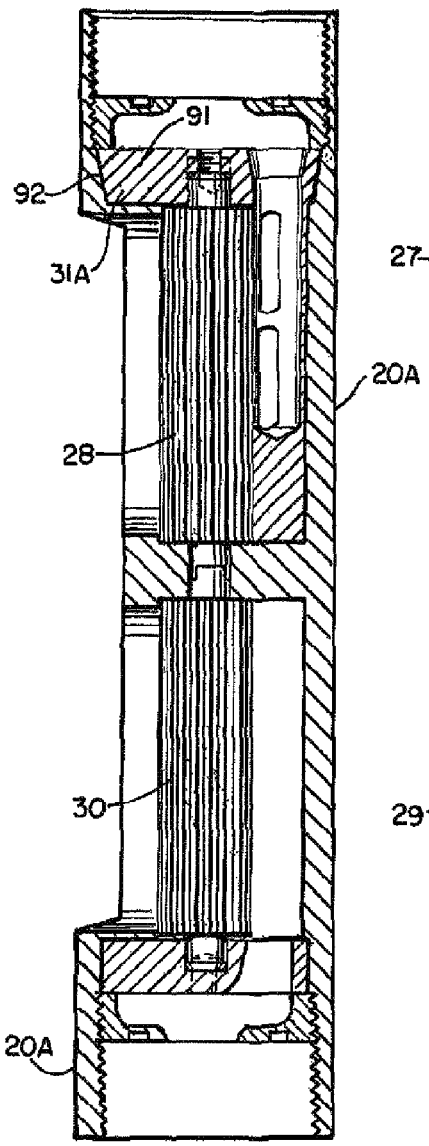
FIG. 26 is a partial sectional elevation view of a preferred embodiment of the apparatus of the present invention.
Figure 27:
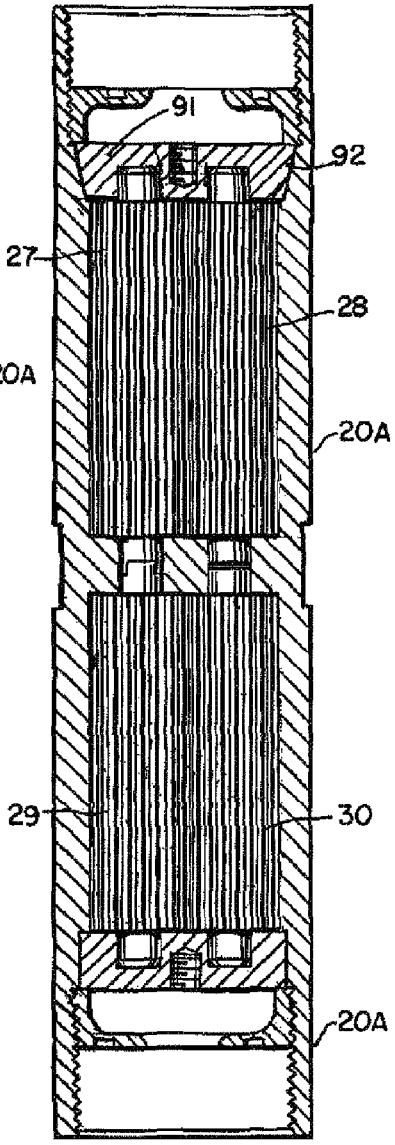
FIG. 27 is a partial sectional elevation view of a preferred embodiment of the apparatus of the present invention.
Figure 28:
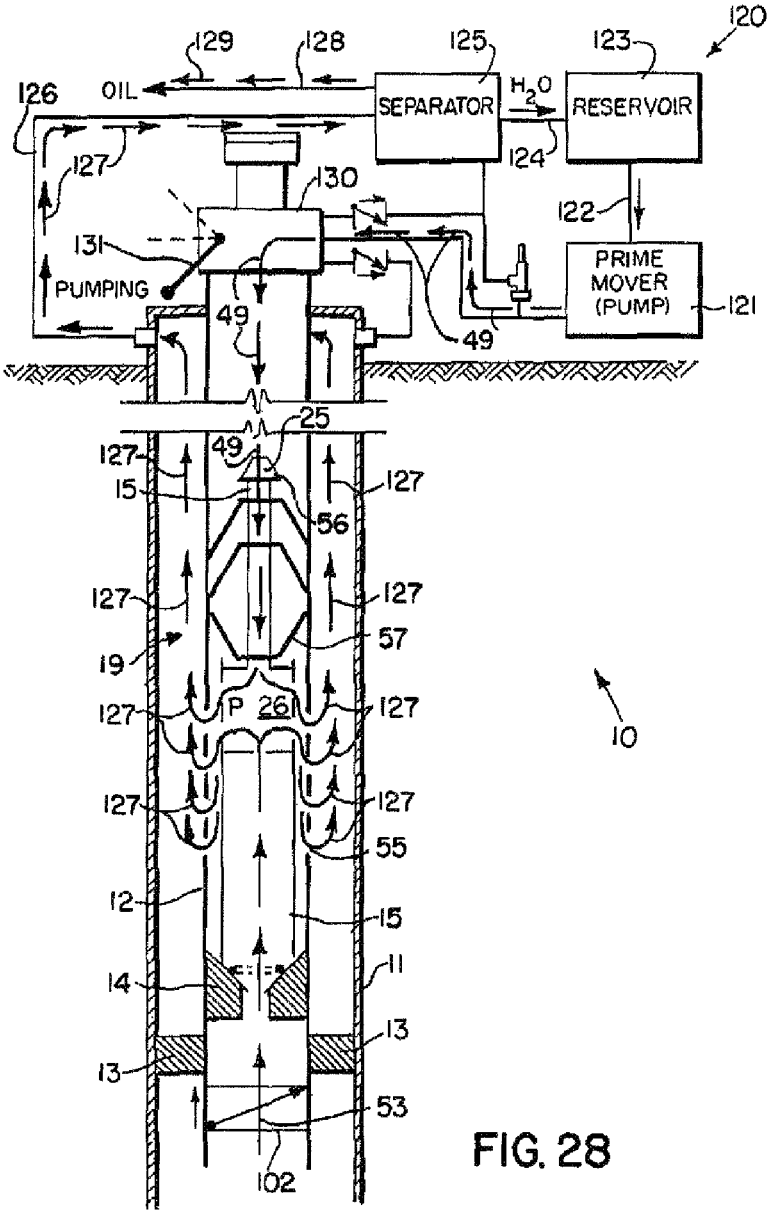
FIG. 28 is a schematic diagram showing operation of the apparatus and method of the present invention in a pumping position.

When the lower impellers 29, 30 turn, they pump produced oil into the well casing annulus 19 (see arrows 53, 54 in FIG. 16; see also FIGS. 26-28). FIGS. 17-21 show the flow of working fluid (arrows 127) and oil (arrows 129). In annulus 19, the oil commingles with the working fluid and returns to the surface (see arrows 129, 127 in FIG. 28). At the surface or wellhead 120, the oil and water (working fluid) enters flow line 126 (arrows 127) and is transmitted to oil/water separator 125. Separator 125 separates produced oil into a selected storage tank via flow line 128 (see arrow 129) and recirculates the power fluid into the reservoir to complete the cycle.

Figure 29:
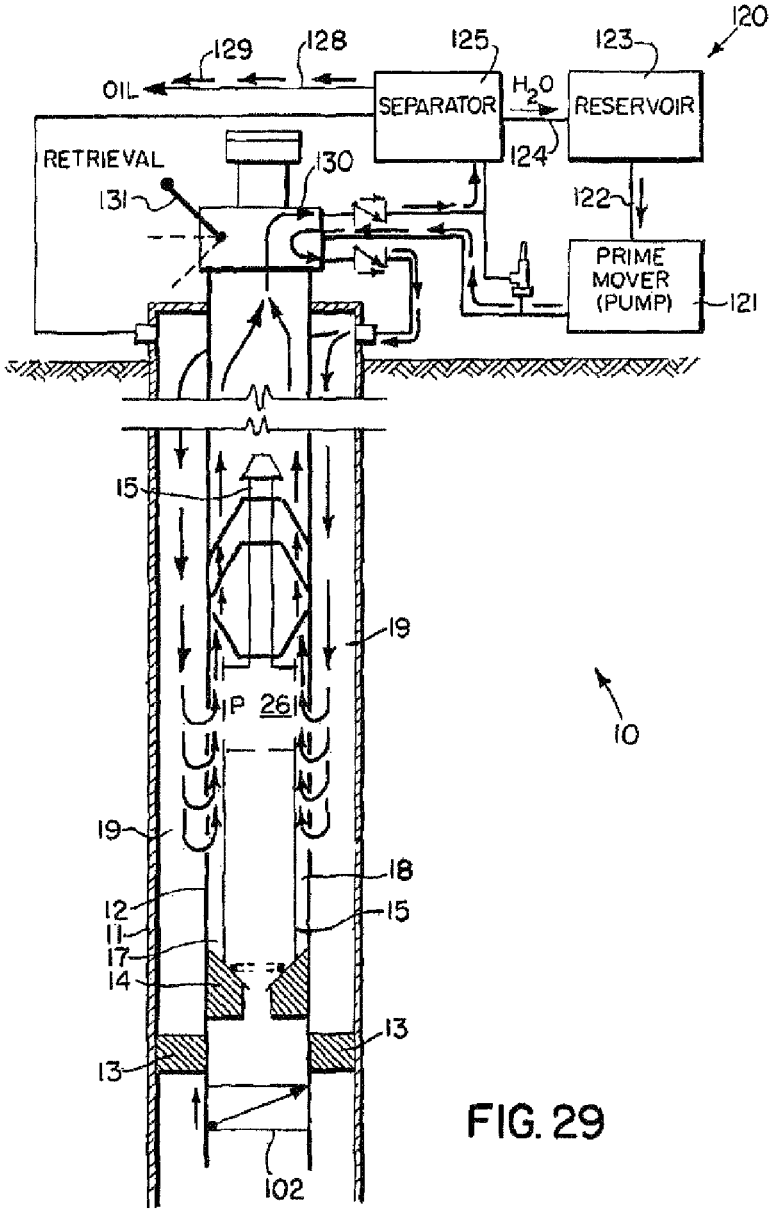
FIG. 29 is a schematic diagram showing operation of the apparatus and method of the present invention in a retrieval position.

In the retrieval mode of FIG. 29, working fluid moves from the reservoir 123 to the prime mover 121. The positive displacement prime mover 121 pumps the working fluid through the three way valve 130. In the retrieval mode, the three way valve handle 131 is in an upper position (as shown in FIG. 29) that allows the working fluid to enter the casing annulus 19.

The working fluid enters the perforated production tubing 12 but does not pass the packer 13. This working fluid that travels in the annulus 19 flares a swab cup or seal 57 against the production tubing 12 causing a seal. The tool body 15 can provide check valves 101, 102 to prevent circulation of the working fluid through the tool body 15 to the oil producing formation that is below packer 13 (see FIGS. 17, 21 and 29). This arrangement causes the tool body 15 to lift upward and return to the wellhead 120 where it can be removed using an overshot. In FIG. 29, the tool body 15 can thus be pumped to the surface or wellhead area 120 for servicing or replacement. The power fluid or working fluid circulates through the three way valve 130 to the oil separator 125 and then to the reservoir 123 completing the cycle.

Figure 30:
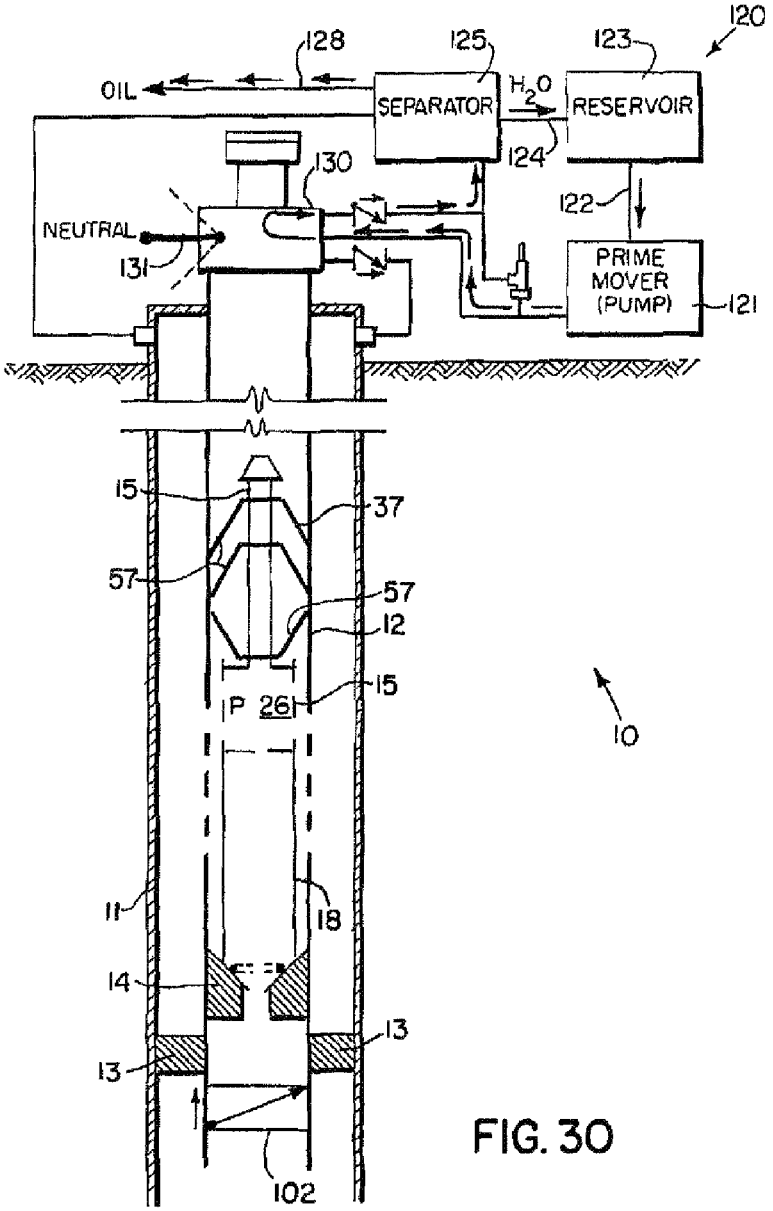
FIG. 30 is a schematic diagram showing operation of the apparatus and method of the present invention in a neutral position.

In FIG. 30, a neutral mode is shown. When the tool body 15 is captured with an overshot, for example, the three way valve 130 is placed in a middle or neutral position as shown in FIG. 30. The FIG. 30 configuration causes the power fluid or working fluid to circulate through the three way valve 130 and directly to the separator 125 and then back to the reservoir 123. The configuration of FIG. 30 produces substantially zero pressure on the tubing 12. A hammer union can be loosened to remove the tool body 15 and release the overshot. The tool body 15 can be removed for servicing or replacement. A replacement pump can then be placed in the tubing 12 bore 18. A well operator then replaces the hammer union and places the handle 131 of the three way valve 130 in the down position of FIG. 28. The tool body 15 is then pumped to the seating nipple 14 as shown in FIG. 28, seating in the seating nipple 14 so that oil production can commence.

In FIGS. 1, 6-7, 12-21 the housing 20 provides an upper end portion 21 having internal threads 22 that enable a connection to be made with upper retainer 32. Housing 20 provides a lower end portion 23 having internal threads 24 that enable a connection to be made with external threads of lower retainer 33.

Pump mechanism 26 (FIGS. 12-16 and 19) provides a plurality of impellers or spur gears. These impellers or spur gears include an upper pair of spur gears 27, 28 and a lower pair of spur gears 29, 30. Flow diverter structure 31 (see FIGS. 9-16, 19, 22-27) is positioned above gears 27, 28, held in place with a retainer 32. Lower retainer 33 and lower bearing 35 are positioned below lower gears 29, 30. Gears 27, 28 are held within upper cavity 36. Gears 29, 30 are held within lower cavity 37 (see FIGS. 6-7). The pair of upper spur gears 27, 28 are contained within upper cavity 36 of housing 20. The lower spur gears 29, 30 are contained in the lower cavity 37 of pump mechanism housing section 20.

Figure 12:
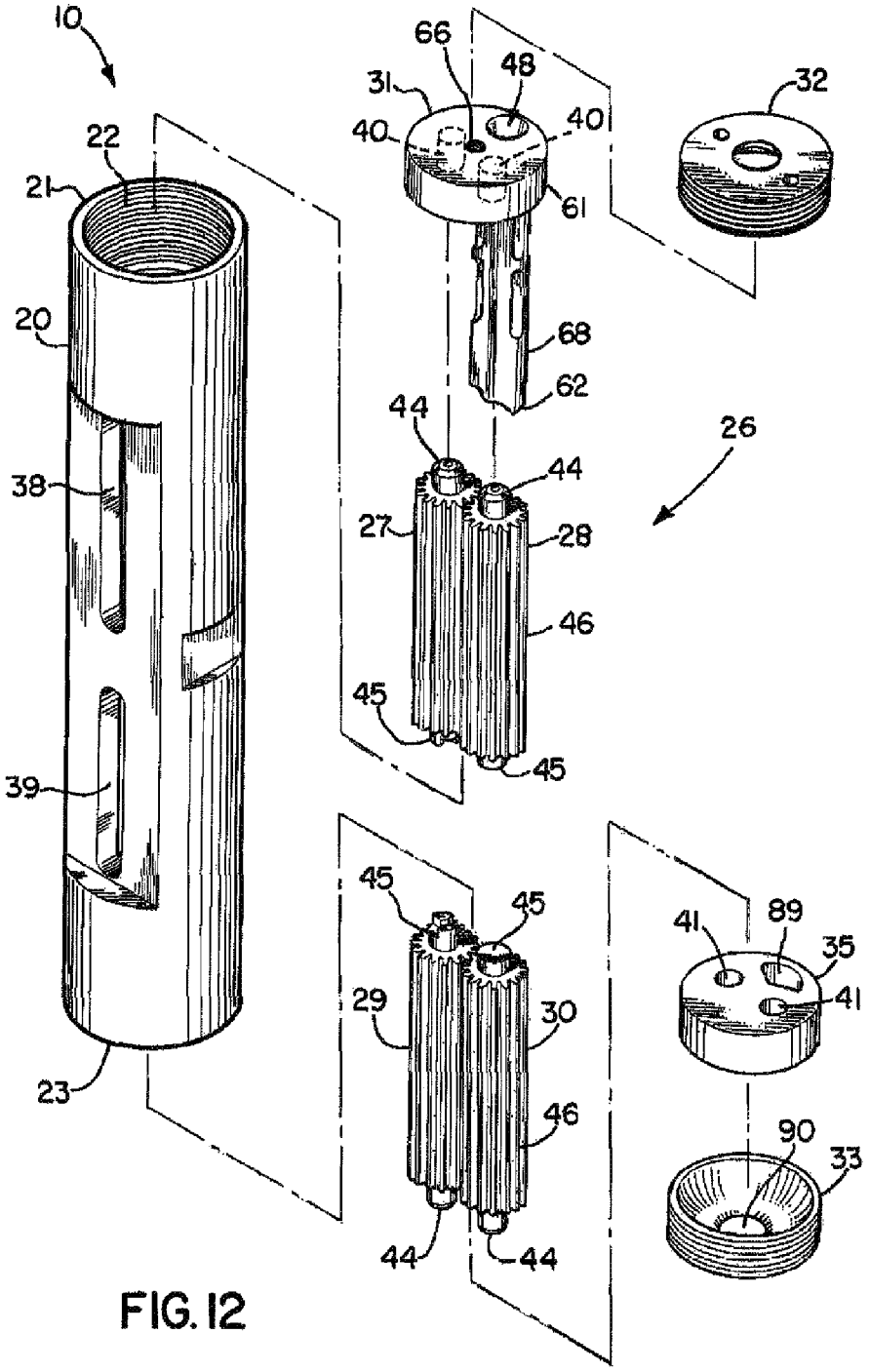
FIG. 12 is an exploded perspective view of a preferred embodiment of the apparatus of the present invention.
Figure 13:
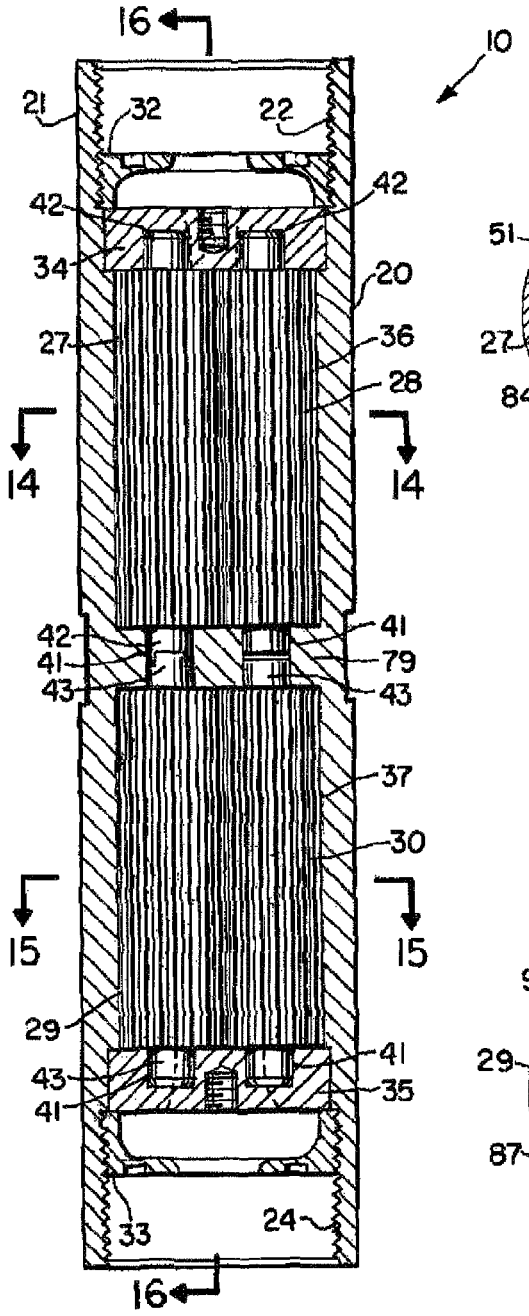
FIG. 13 is a sectional elevation view of a preferred embodiment of the apparatus of the present invention.
Figure 14:
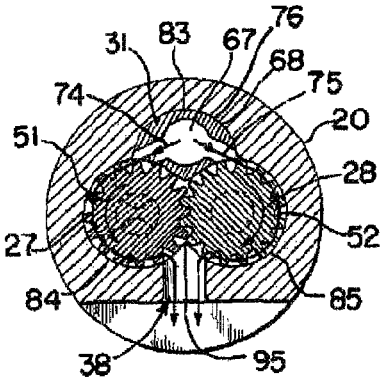
FIG. 14 is a sectional view taken along lines 14-14 of FIG. 13.

Locking pins can be used to prevent disassembly of either of the retainers 32, 33 from pump mechanism housing 20. Longitudinally extending slots or slotted openings 38, 39 are provided in pump housing section 20 as shown in FIGS. 1, 3, 5-7, 12 and 16. Shaft openings 40, 41 are provided in housing section 20 and communicating in between upper cavity 36 and lower cavity 37 (see FIGS. 12-13). The shaft openings 40, 41 enable shafts 42, 43 to extend between upper spur gear 27, and lower spur gear 29 (see FIGS. 12, 12A-12F and 13). In FIGS. 12, 12A-12F and 13, upper spur gear 27 is connected to lower spur gear 29 with shafts 42, 43. Upper spur gear 28 does not have to be connected to lower spur gear 30 with a shaft (see FIG. 12B). The upper spur gear 27 rotates with lower spur gear 29. The gears 28, 30 rotate, driven by the gears 27, 29. Each gear 27, 28 has circumferentially spaced, radially extending teeth 46. The teeth 46 of spur gear 27 engage the teeth 46 of spur gear 28 as seen in FIG. 14. Similarly, the teeth 46 of spur gear 29 engage the teeth of spur gear 30 (see FIG. 15). Thus gear 27 rotates and drives rotator gear 28. Gear 29 rotates and drives/rotates gear 30.

Each shaft 42, 43 has a generally cylindrically shaped section 44 and a splined section 45. The cylindrically shaped section 44 of each shaft 42, 43 is connected to a bearing 34 or 35 as shown in FIGS. 12, 13. The splined sections 45 of each shaft 42, 43 interlock to connect one section 45 (of shaft 42) to the other splined section 45 of shaft 43 as seen in FIGS. 12A-12F. Each of the spur gears 27-30 can have the same number of longitudinally extending and radially extending, circumferentially spaced apart teeth 46 as shown in FIGS. 12-16. Each gear 27-30 is contained within a shaped section of cavity 36 or 37 (see FIGS. 6-7).

Figure 12A:
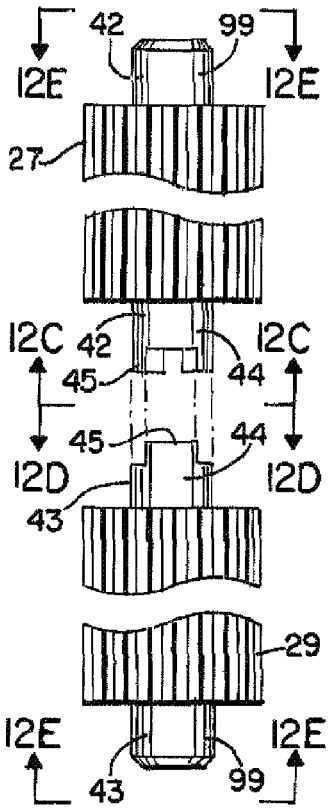
FIGS. 12A-12B are fragmentary views illustrating the gears or impellers.
Figure 12B:
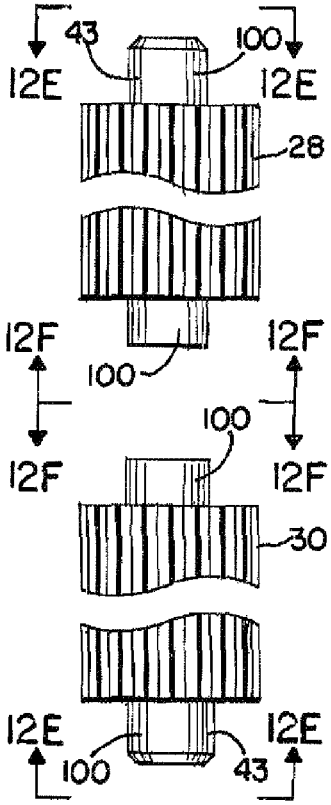
Figure 12C:
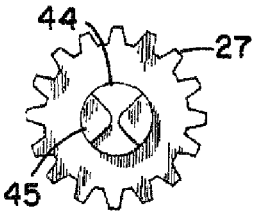
FIG. 12C is a sectional view taken along lines 12C-12C of FIG. 12A.
Figure 12E:
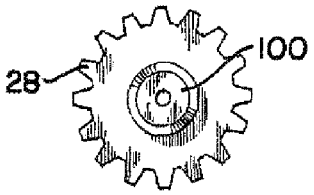
FIG. 12E is a sectional view taken along lines 12E-12E of FIG. 12B.
Figure 12D:
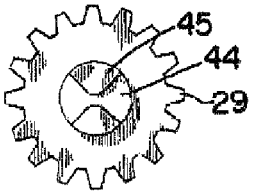
FIG. 12D is a sectional view taken along lines 12D-12D of FIG. 12A.
Figure 12F:
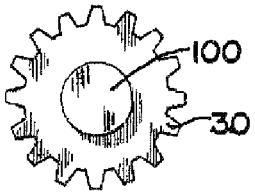
FIG. 12F is a sectional view taken along lines 12F-12F of FIG. 12B.

FIGS. 12A-12F show the impellers or spur gears 27-30 in more detail. Spur gear 27 has an upper end portion that provides cylindrically shaped section 99. Similarly, the spur gear 29 provides a lower end portion having a cylindrically shaped section 99. Each of the spur gears 28, 30 has end portions that are cylindrically shaped. The spur gear or impeller 28 has cylindrically shaped end portions 100. Similarly, the spur gear or impeller 30 has cylindrically shaped sections 100. The cylindrically shaped sections 99 are part of shaft 42, 43 as shown in FIG. 12A. Similarly, the cylindrically shaped sections 100 of impellers 28, 30 are parts of shaft 43. The lower end portion of shaft 43, cylindrically shaped section 99 rests in a cylindrically shaped opening 41 of lower bearing/shaft support 35 (see FIG. 13). The upper end portion 99 of spur gear 27 is placed in shaft opening 40 of diverter structure 31 or 31A. Each of the splined sections 45 and cylindrically shaped sections 44 of shafts 42, 43 occupy a cylindrically shaped opening 98 that is in the transverse plate 79 section of body 20 (see FIGS. 4-8, 12-14). The lower end portion of shaft 43 which is cylindrically shaped section 100 also occupies a cylindrically shaped opening 98 as shown in FIGS. 3-4 and 12-13. The upper end portion of impeller or gear 30 provides cylindrically shaped section 100 that also occupies cylindrically shaped opening 98 of body 20 as shown in FIGS. 3-7, 13. Notice in FIG. 13 that the shafts 43 of spur gears 28 and 30 do not necessarily have to meet. There can be a gap there between as shown in FIG. 13. In this fashion, the spur gear 27 rotates with and drives the spur gear 28. Similarly, the spur gear 29 rotates with and drives the spur gear 30.

Figure 8:
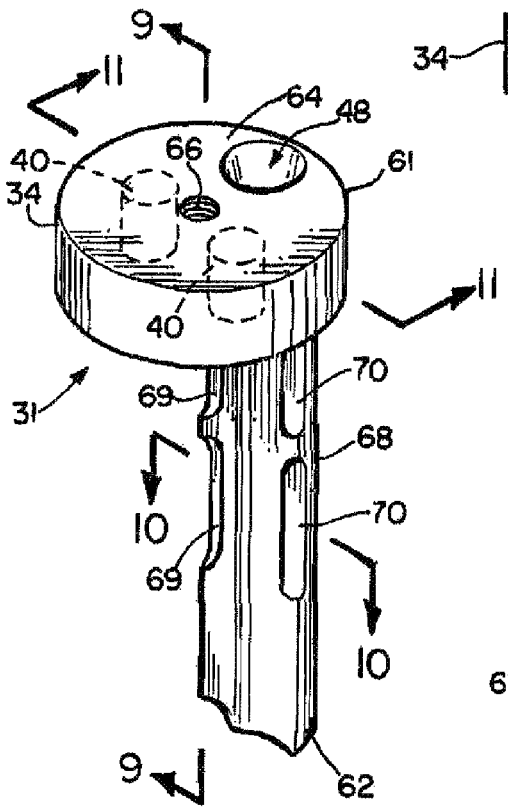
FIG. 8 is a fragmentary perspective view of a preferred embodiment of the apparatus of the present invention.
Figure 9:
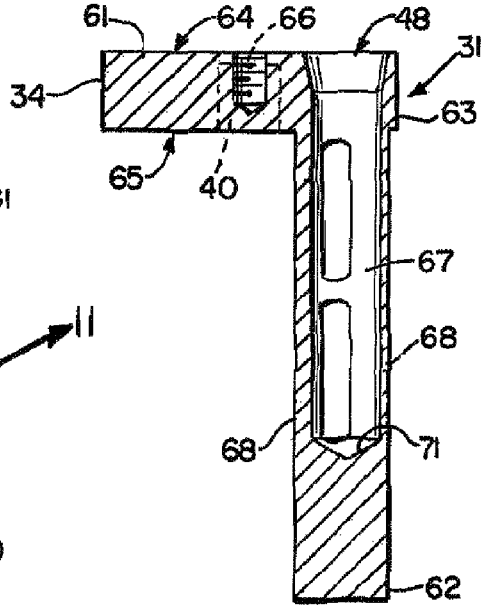
FIG. 9 is a sectional view taken along lines 9-9 of FIG. 8.
Figure 10:
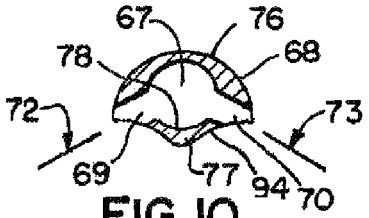
FIG. 10 is a sectional view taken along lines 10-10 of FIG. 8.
Figure 11:
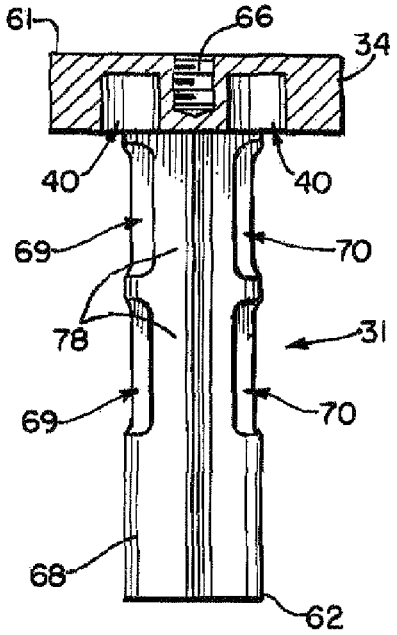
FIG. 11 is a sectional view taken along lines 11-11 of FIG. 8.

Each of the upper and lower cavities 36, 37 provides a section that is shaped to hold diverter structure 31. FIGS. 8-16 and 19 show the diverter structure 31 in more detail. Diverter structure 31 has an upper end portion 61 connected to lower end portion 62 at joint 63. Upper end portion 61 is in the form of a disk or upper bearing 34 as shown in FIGS. 8, 9 and 11. The disk 34 has upper surface 64 and lower surface 65. Internally threaded opening 66 is provided on disk 34 at upper surface 64 as shown in FIGS. 8-9 and 11. The internally threaded opening 66 enables the diverter structure 31 to be removed for servicing or replacement. An externally threaded shaft or tool can be connected to the internally threaded opening 66 for enabling the diverter structure 31 to be lifted upwardly from pump housing section 20. Diverter structure 61 has a vertical or longitudinal section 68 having an internal flow channel 67. The flow channel 67 communicates with channel opening 48 as shown in FIGS. 8-9 and 11.

Ports are provided for discharging fluid from the vertical or longitudinal section 68. The ports 69, 70 discharge fluid in opposing directions as indicated by the reference lines 72 and 73 at FIG. 10. These ports 69,70 are thus angularly oriented, preferably forming an obtuse angle which would be the angle between the reference lines 72 and 73 in FIG. 10.

Flow channel 67 has a lower or closed end 71. Therefore, when the working fluid reaches the diverter structure 31, it enters the channel 67 by way of opening 48. Flow in channel 67 is discharged through the ports 69 and 70 as illustrated by the arrows 74, 75 in FIG. 14. In this fashion, the working fluid discharged through port 69 engages the teeth 46 of impeller 27. The flow discharged from channel 67 through port 70 engages the teeth 46 of impeller 28 (see FIGS. 11, 12 and 13).

Diverter structure 31 vertical or longitudinal section 68 has a rear surface 76 and a front surface 77. The front surface 77 is part of a dam 78 that prevents working fluid from flowing to the interface or interlock at 95 of the impellers 27, 28 (see FIGS. 10, 14). The gears are impellers 27, 28 thus rotate in the direction of arrows 74, 75 respectively as shown in FIG. 14.

Pump housing section 20 provides a transverse plate 79 that segregates or separates the upper and lower cavities 36, 37 as shown in FIGS. 2-7, 13 and 16. The pump housing section 20 can be provided with flat surfaces at 80, 81, and 82 (see FIGS. 2-5). The flat surfaces 81, 82 can be tool receptive surfaces for enabling a user to rotate the pump housing section 20 relative to the tool body section 15 such as during assembly or disassembly with other parts such as those shown in FIG. 12.

Figure 1:
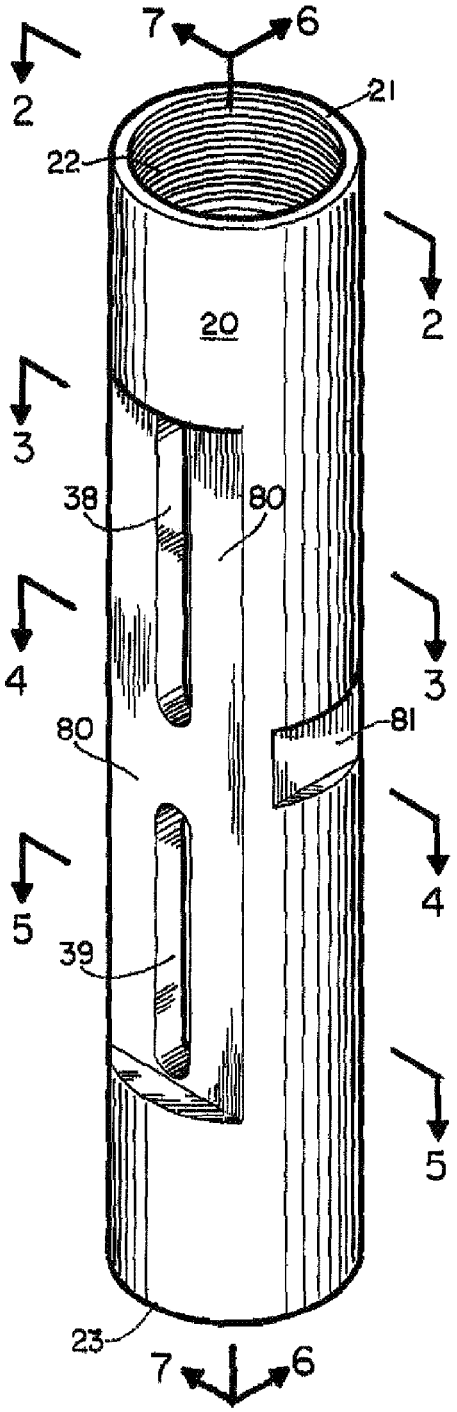
FIG. 1 is a perspective view of a preferred embodiment of the apparatus of the present invention.
Figure 2:
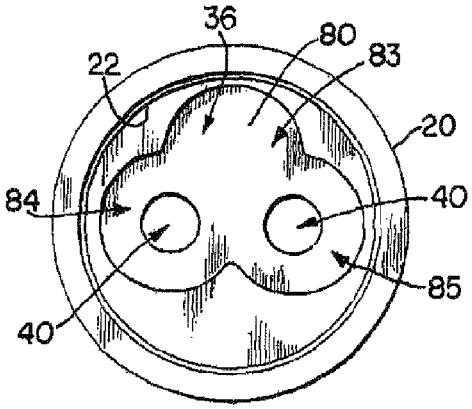
FIG. 2 is a sectional view taken along lines 2-2 of FIG. 1.
Figure 3:
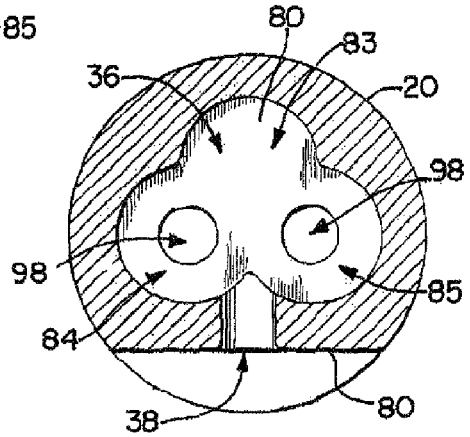
FIG. 3 is a sectional view taken along lines 3-3 of FIG. 1.
Figure 4:
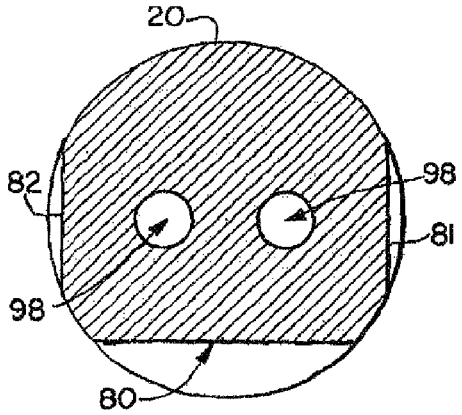
FIG. 4 is a sectional view taken along lines 4-4 of FIG. 1.
Figure 5:
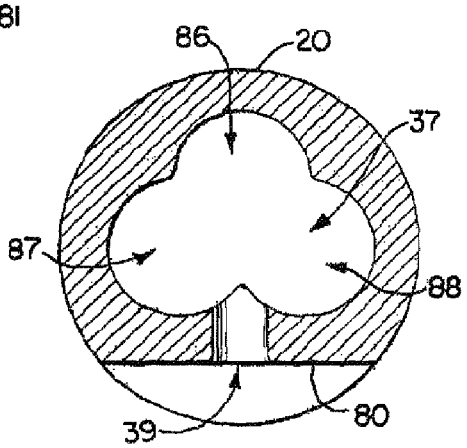
FIG. 5 is a sectional view taken along lines 5-5 of FIG. 1.
Figure 6:
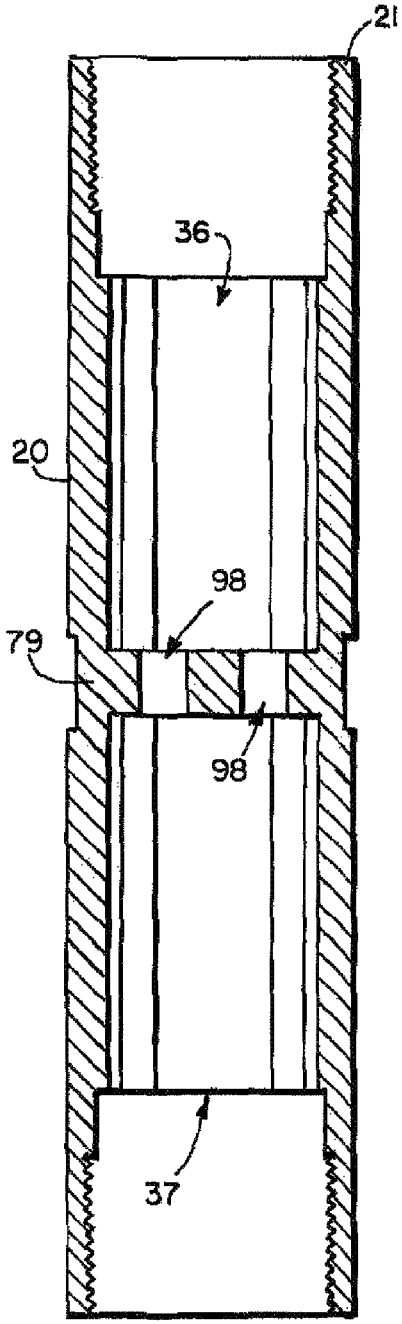
FIG. 6 is a sectional view taken along lines 6-6 of FIG. 1.
Figure 7:
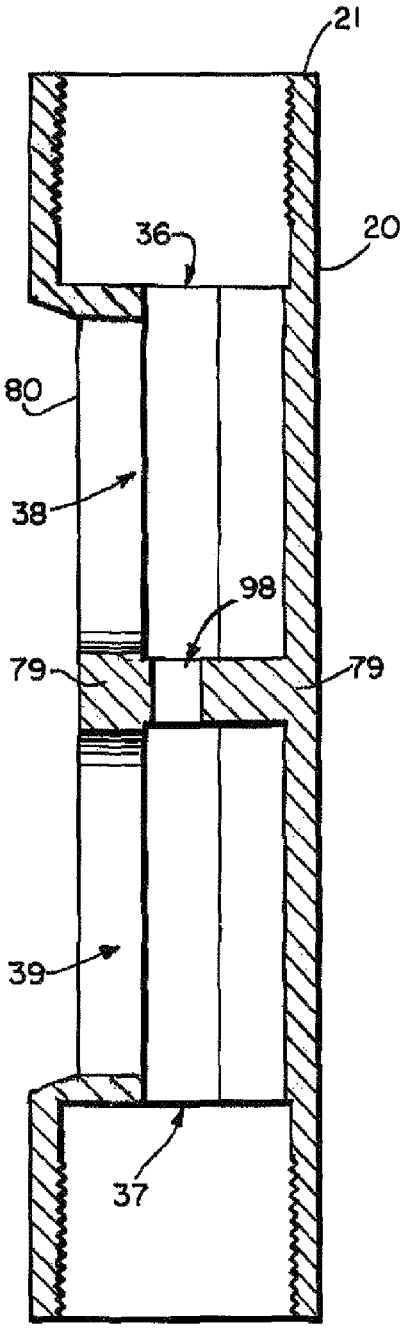
FIG. 7 is a sectional view taken along lines 7-7 of FIG. 1.

Each of the upper and lower cavities 36, 37 has three lobes or partial cylindrical sections. For example, in FIGS. 2-3, there can be seen partial cylindrical sections 83, 84, 85 which are a part of upper cavity 36. In FIG. 5, the lower cavity 37 is comprised of three partial cylindrical sections 86, 87, 88. In the upper cavity 36, each of the lobes 84, 85 carries a spur gear or impeller 26 or 27. The lobe or portion cylindrical section 83 carries the vertical or longitudinal section 68 of diverter structure 31. In lower cavity 37, each of the lobes or partial cylindrical sections 87, 88 carries a spur gear or impeller 29 or 30. The lobe or partial cylindrical section 86 provides a channel for the transport of oil to be pumped as illustrated by arrows 53 and 54 in FIG. 16.

The oil to be pumped travels upwardly as it is pumped by the rotating impellers 29, 30. The direction of the lower impellers 29, 30 can be seen in FIG. 15 and marked with the arrows 96, 97.

Lower bearing 35 has a pair of spaced apart shaft openings 41 through a receptive of the shafts 43 of impellers 29 and 30 (see FIG. 13).

Lower retainer 33 has an opening 90 through which oil flows as illustrated by the arrow 53 in FIG. 16. Lower bearing 35 provides a flow opening 89 through which oil can flow in order to reach the impellers 29, 30 as shown in FIG. 13, 16.

Figure 23:
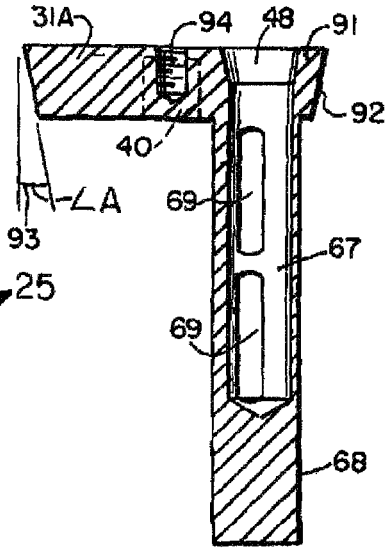
FIG. 23 is a sectional view taken along lines 23-23 of FIG. 22.
Figure 24:
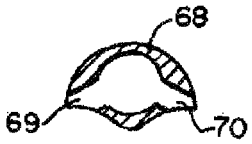
FIG. 24 is a sectional view taken along lines 24-24 of FIG. 22.
Figure 25:
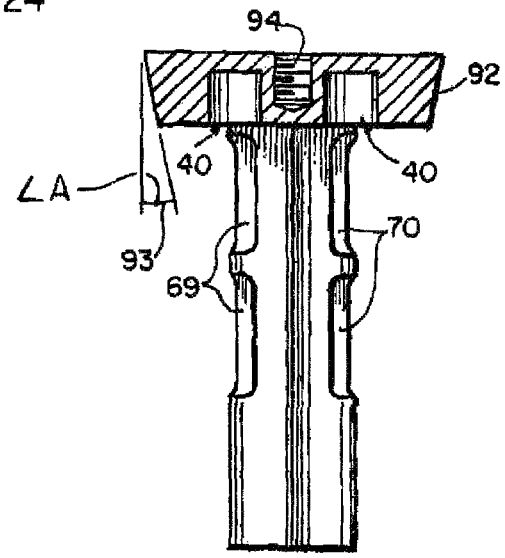
FIG. 25 is a sectional view taken along lines 25-25 of FIG. 22.

An alternate embodiment of the diverter structure is seen in FIGS. 22-27, designated by the numeral 31A. In FIGS. 22-27, the diverter structure 31A provides a structure that is basically the same as the diverter structure 31, the difference being the provision of a beveled annular surface 92 on a frusto conical disk 91 and a correspondingly shaped beveled annular surface 132 on housing 20A. The disk 91 provides the same opening 48, shaft openings 40, and vertical/longitudinal section 68 as the diverter structure 31 with flow channel 67 and ports 69, 70. In FIGS. 23 and 25, the frusto conical disk 91 has beveled angular surface 92 which forms an angle 93 that is an acute angle with upper surface 64. Internally threaded opening 94 accepts a threaded tool (e.g. bolt) for removing diverter 31A from pump housing body 20A.

Figure 15:
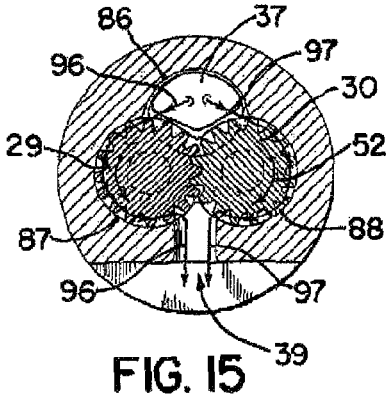
FIG. 15 is a sectional view taken along lines 15-15 of FIG. 13.

Influent working fluid travels from influent channel opening 48 downwardly in the direction of arrows 49, 50 in FIG. 16. This influent fluid that follows arrows 49, 50 is the working fluid, the same working fluid described with respect to FIGS. 28-30. The working fluid travels in the direction of arrows 49, 50 from rear section of upper cavity 36 and through upper spur gears 27, 28 as indicated by arrow 49, 50 in FIG. 16. This fluid flow rotates the gear 27 in the direction of arrow 51 and the gear 28 in the direction of arrow 52 as shown in FIGS. 14, 15. This rotation of the upper gears 27, 28 also rotates the lower gears 29, 30.

Oil to be pumped travels in the direction of arrows 53, 54 into oil inlet opening/perforation 55 and into the rear section of lower cavity 37 and through the gears 29, 30. The flowing working fluid which follows the direction of arrows 49, 50 in FIG. 16 exits the upper cavity 36 via upper slot 38. The oil being pumped travels in the direction of arrows 53, 54 and exits lower slot 39, mixing with the working fluid. The working fluid and oil pass through perforations 55, returning to the surface area via annulus 19 (see arrows 127).

The following is a list of suitable parts and materials for the various elements of a preferred embodiment of the present invention.

PARTS LIST

| Part Number | Description |
|---|---|
| 10 | oil well pump apparatus |
| 11 | well casing |
| 12 | production tubing |
| 13 | packer |
| 14 | landing/seating nipple |
| 15 | tool body |
| 16 | upper end portion |
| 17 | lower end portion |
| 18 | bore |
| 19 | well annulus |
| 20 | pump housing section |
| 20A | housing |
| 21 | upper end portion |
| 22 | internal threads |
| 23 | lower end portion |
| 24 | internal threads |
| 25 | neck |
| 26 | pump mechanism |
| 27 | impeller/spur gear, upper |
| 28 | impeller/spur gear, upper |
| 29 | impeller/spur gear, lower |
| 30 | impeller/spur gear, lower |
| 31 | diverter structure |
| 31A | diverter structure |
| 32 | retainer, upper |
| 33 | retainer, lower |
| 34 | disk/upper bearing |
| 35 | lower bearing/shaft support |
| 36 | upper cavity |
| 37 | lower cavity |
| 38 | slot/slotted opening |
| 39 | slot/slotted opening |
| 40 | shaft opening |
| 41 | shaft opening |
| 42 | shaft |
| 43 | shaft |
| 44 | cylindrically shaped section |
| 45 | splined section |
| 46 | teeth |
| 47 | tool section |
| 48 | channel opening |
| 49 | arrow |
| 50 | arrow |
| 51 | arrow |
| 52 | arrow |
| 53 | arrow |
| 54 | arrow |
| 55 | perforation/inlet opening |
| 56 | annular shoulder |
| 57 | seal |
| 58 | channel |
| 59 | stacked disk filter |
| 60 | bore |
| 61 | upper end portion |

-continued

| PARTS LIST | |
|---|---|
| Part Number | Description |
| 62 | lower end portion |
| 63 | joint |
| 64 | upper surface |
| 65 | lower surface |
| 66 | internally threaded opening |
| 67 | flow channel |
| 68 | vertical/longitudinal section |
| 69 | port |
| 70 | port |
| 71 | closed end of channel |
| 72 | reference line |
| 73 | reference line |
| 74 | arrow |
| 75 | arrow |
| 76 | rear surface |
| 77 | front surface |
| 78 | dam |
| 79 | transverse plate |
| 80 | flat surface |
| 81 | flat surface |
| 82 | flat surface |
| 83 | lobe/partial cylindrical section |
| 84 | lobe/partial cylindrical section |
| 85 | lobe/partial cylindrical section |
| 86 | lobe/partial cylindrical section |
| 87 | lobe/partial cylindrical section |
| 88 | lobe/partial cylindrical section |
| 89 | opening |
| 90 | opening |
| 91 | frusto conical disk |
| 92 | beveled annular surface |
| 93 | angle |
| 94 | internally threaded opening |
| 95 | interface/interlock |
| 96 | arrow |
| 97 | arrow |
| 98 | cylindrically shaped opening |
| 99 | cylindrically shaped section |
| 100 | cylindrically shaped section |
| 101 | check valve |
| 102 | check valve |
| 120 | wellhead area |
| 121 | prime mover |
| 122 | flowline |
| 123 | reservoir |
| 124 | flowline |
| 125 | separator |
| 126 | flowline |
| 127 | arrow |
| 128 | flowline |
| 129 | arrow |
| 130 | three way valve |
| 131 | handle |
| 132 | beveled annular surface |

The foregoing embodiments are presented by way of example only; the scope of the present invention is to be limited only by the following claims.

The invention claimed is:

1. An oil pump apparatus for pumping oil from an oil well having a wellhead with a wellhead area, and a well bore with a casing and a production tubing, comprising:

a) a tool body that is sized and shaped to be lowered into the production tubing of the oil well;

b) a working fluid that can be pumped into the production tubing;

c) a prime mover for pumping the working fluid;

d) a flow channel in the well bore that enables the working fluid to be circulated from the prime mover via the production tubing to the tool body at a location in the well and then back to the wellhead area;

e) a flow diverter structure mounted in the tool body, the flow diverter structure including a bearing and a vertically extending portion that extends down from the bearing;

f) a pumping mechanism on the tool body, the pumping mechanism including a first pair of impellers that are driven by the working fluid and a second pair of impellers that are rotated by the first pair of impellers, the second pair of impellers pumping oil from the well via the tool body, each pair of impellers having blades that engage so that one impeller rotates with the other for each of said pairs;

g) the first pair of impellers rotatably attached to the bearing of the flow diverter, h) wherein the working fluid flows downwardly through the flow diverter and then to the first pair of impellers;

i) wherein the vertically extending portion of the flow diverter has a plurality of discharge ports including at least two discharge ports that form an obtuse angle and that direct fluid flow to an outer half portion of the impeller blades of the first of impellers;

j) wherein the tool body has flow conveying portions that mix the working fluid and the oil as the oil is pumped; and k) wherein the pumping mechanism transmits the commingled fluid of oil and working fluid to the wellhead area.

2. The oil pump apparatus of claim 1 further comprising a filter in the tool body that is positioned to filter the working fluid before it reaches the pumping mechanism.

3. The oil pump apparatus of claim 1 further comprising a filter in the tool body that is positioned to filter the oil being pumped before it reaches the pumping mechanism.

4. The oil pump apparatus of claim 1 wherein the working fluid is water or oil or a mixture of oil and water.

5. The oil pump apparatus of claim 1 wherein the working fluid is a fluid mixture of oil and water.

6. The oil pump apparatus of claim 1 wherein the working fluid is oil.

7. An oil pump apparatus for pumping oil from an oil well having a wellhead with a wellhead area, a well bore, and a production tubing, comprising:

a) a tool body that is sized and shaped to be lowered into the production tubing of the oil well;

b) a working fluid that can be pumped into the production tubing;

c) a flow channel in the well bore that enables the working fluid to be circulated via the production tubing to the tool body at a location in the well and then back to the wellhead area;

d) a flow diverter carried in the tool body and positioned to receive flow from the flow channel, the flow diverter including a disk and a vertically extending portion attached to the disk and having a generally vertically oriented flow bore;

e) a pumping mechanism on the tool body, the pumping mechanism including first impellers that are driven by the working fluid and second impellers that are rotated by the first impellers, the second impellers pumping oil from the well via the tool body;

f) wherein the vertically extending portion of the flow diverter has a plurality of discharge ports including at least two discharge ports that form an obtuse angle and that direct fluid flow to the first impellers;

g) wherein the tool body has flow conveying portions at mix the working fluid and the oil as the oil is pumped; and h) wherein the pumping mechanism transmits the commingled fluid of oil and working fluid to the wellhead area.

8. An oil pump apparatus for pumping oil from an oil well having a wellhead with a wellhead area and a well bore with a casing and a production tubing, comprising:

a) a tool body that is sized and shaped to be lowered into the production tubing of the oil well, the tool body having a tool body bore and upper and lower end portions;

b) a working fluid that can be pumped into the production tubing;

c) a prime mover for pumping the working fluid;

d) a flow channel in the well bore that enables the working fluid to be circulated from the prime mover via the production tubing to the tool body at a location in the well and then back to the wellhead area;

e) a flow diverter that occupies the tool body bore at the upper end portion of the tool body and is positioned to receive flow from the flow channel, the flow diverter having a transverse disk and a downwardly extending member having discharge ports;

f) a pumping mechanism on the tool body, the pumping mechanism including a first impeller that is driven by the working fluid and a second impeller that is rotated by the first impeller, the second impeller pumping oil from the well via the tool body, wherein each impeller has impeller teeth;

g) wherein the tool body has flow conveying portions that mix the working fluid and the oil as the oil is pumped;

h) wherein the pumping mechanism transmits the commingled fluid of oil and working fluid to the wellhead area; and i) wherein the flow diverter has a plurality of discharge ports that are vertically spaced apart to direct fluid to the first impeller at upper and lower positions.

9. An oil pump apparatus for pumping oil from an oil well having a wellhead with a wellhead area and a well bore with a casing and a production tubing, comprising:

a) a tool body that is sized and shaped to be low d into the production tubing of the oil well;

h) a working fluid that can be pumped into the production tubing;

c) a prime mover for pumping the working fluid;

d) a flow channel in the well bore that enables the working fluid to be circulated from the prime mover via the production tubing to the tool body at a location in the well and then back to the wellhead area;

e) a pumping mechanism on the tool body, the pumping mechanism including first impellers that are driven by the working fluid and second impellers that are rotated by the first impellers, the second impellers pumping oil from the well via the tool body;

wherein the tool body has flow conveying portions that mix the working fluid and the oil as the oil is pumped;

g) wherein the pumping mechanism transmits the commingled fluid of oil and working fluid to the wellhead area;

h) a flow diverter that receives flow from the flow channel and transmits that received flow to the first impellers at first upper and second lower positions; and i) wherein the first and second impellers include upper and lower pairs of impellers, one of the upper impellers connected to and rotating with one of the lower impellers.

10. The oil pump apparatus of claim 9 wherein one of the upper impellers and one of the lower impellers are connected by a common shaft.

11. The oil pump apparatus of claim 9 further comprising a filter in the tool body that is positioned to filter the working fluid before it reaches the pumping mechanism.

12. The oil pump apparatus of claim 9 further comprising a filter in the tool body that is positioned to filter the oil being pumped before it reaches the pumping mechanism.

13. The oil pump apparatus of claim 9 wherein the working fluid is water.

14. The oil pump apparatus of claim 9 wherein the working fluid is oil.

15. The oil pump apparatus of claim 9 wherein the working fluid is a mixture of water and a material that is not water.

16. The oil pump apparatus of claim 10 wherein the working fluid is a fluid mixture of oil and water.

17. The oil pump apparatus of claim 9 further comprising a swab cup on the tool body that enables the tool body to be pumped into the well bore via the production tubing using the working fluid.

18. The oil pump apparatus of claim 9 further comprising a check valve positioned on the tool body above the pumping mechanism that prevents oil flow inside the tool body above the pumping mechanism.

19. The oil pump apparatus of claim 9 further comprising a check valve positioned below the pumping mechanism that prevents the flow of the working fluid inside the tool body to a position below the tool body.

20. The oil pump apparatus of claim 9 wherein a shaft of one of said upper impellers is connected to a shaft of one of said lower impellers to form a common shaft.

* * * * *